United States Patent [19]

Hattori et al.

[11] 4,326,900

[45] Apr. 27, 1982

[54] WATER-IN-OIL EMULSION EXPLOSIVE COMPOSITION

[75] Inventors: Katsuhide Hattori; Yoshiaki Fukatsu; Masao Takahashi, all of Aichi, Japan

[73] Assignee: Nippon Oil and Fats Company Limited, Kanagawa, Japan

[21] Appl. No.: 97,668

[22] Filed: Nov. 27, 1979

[30] Foreign Application Priority Data

Nov. 28, 1978 [JP] Japan ..... 53/146738

[51] Int. Cl.[3] ..... C06B 45/00

[52] U.S. Cl. ..... 149/2; 149/47; 149/62; 149/78; 149/89

[58] Field of Search ..... 149/2, 2 F, 47, 62, 149/78, 89

[56] References Cited

U.S. PATENT DOCUMENTS

| | | | |
|---|---|---|---|
| 3,419,444 | 12/1968 | Minnick | 149/2 F |
| 3,674,578 | 7/1972 | Cattermole et al. | 149/47 |
| 3,770,522 | 11/1973 | Tomil | 149/2 |
| 4,008,110 | 2/1977 | Machacek | 149/89 |
| 4,097,316 | 6/1978 | Mullay | 149/47 |
| 4,104,092 | 8/1978 | Mullay | 149/2 |
| 4,111,727 | 9/1978 | Clay | 149/2 |
| 4,175,990 | 11/1979 | Hattori et al. | 149/89 |

*Primary Examiner*—Edward A. Miller

*Attorney, Agent or Firm*—Stevens, Davis, Miller & Masher

[57] ABSTRACT

Water-in-oil emulsion explosive compositions containing (e) nitromethane gelatinized product obtained by mixing nitromethane with a gelatinizer for nitromethane and (f) hollow microspheres and/or (g) bubbles formed from a chemical foaming agent in a water-in-oil emulsion composition consisting of (a) ammonium nitrate or ammonium nitrate and the other inorganic oxidizer salts, (b) water, (c) an oil and/or wax and (d) a sorbitan fatty acid ester surfactant.

12 Claims, No Drawings

WATER-IN-OIL EMULSION EXPLOSIVE COMPOSITION

The present invention relates to water-in-oil (W/O) emulsion explosive compositions having excellent stability in storage, detonability at low temperature, explosion reactivity, safety and sympathetic detonation obtained by adding to a water-in-oil emulsion composition formed by using a sorbitan surfactant as an emulsifier, a mixture of nitromethane and hollow microsphere, a mixture of nitromethane and a chemical foaming agent or a mixture of nitromethane, hollow microsphere and a chemical foaming agent.

Heretofore, the improvement of explosion reactivity (usually represented by the explosion velocity) in general explosives has been effected by (1) selecting the components of the explosive composition or (2) varying the mixed state between each component of the explosive composition. The above described former method (1) comprises selecting substances having a high reaction velocity or selecting substances which generate a large heat energy upon the reaction, that is have a high explosion heat and the like. The above described latter method (2) comprises contacting an oxidizer with a fuel in fine grain form, that is increasing the contact area or dissolving these substances with each other through water to increase the contact area.

Accordingly, when a water soluble substance and a water insoluble substance are contained in a slurry explosive, it is very difficult to contact both the substances in a dissolution state through water, so that it is necessary to form a mixed phase wherein an aqueous solution of a water soluble substance and a water insoluble substance are contacted in the state where both the substances are formed into grain states to increase the contact area.

Almost all of conventional slurry explosive compositions have been oil-in-water (referred as O/W hereinafter) emulsion explosive compositions, in which water, which is the major component, envelops water insoluble substances or water soluble substances which can not be fully dissolved in water and remain in water. The major part of the water insoluble substances in the O/W emulsion explosive compositions is oxidizers, for example inorganic oxidizer salts, such as ammonium nitrate and the like and the major part of water insoluble substances are fuels or sensitizers which act as a fuel together, for example aluminum, nitromethane and the like.

In general, in slurry explosive compositions, when the components are classified into water insoluble substances (referred to as "O") and water soluble substances (referred to as "W") and the compounding ratio by weight is considered, O/W is generally not more than 25/75. Thus, when it is considered that the dispersed particle size in O/W emulsion and W/O emulsion is equal, the contact area of O and W is larger in W/O emulsion wherein O which is smaller in the amount, envelops W which is larger in the amount, than in O/W emulsion. Accordingly, it is expected that the explosion reactivity is improved in W/O emulsion. As the results, the explosive wherein smoke is few and the after-detonation fume is good, can be obtained. Thus, in view of increase of the contact area, a variety of W/O emulsion explosive compositions have been disclosed instead of the prior O/W emulsion explosive compositions in U.S. Pat. Nos. 3,212,945; 3,356,547; 3,442,727; 3,447,978; 3,674,578; 3,765,964 and 3,770,522. In these W/O emulsion explosive compositions, the performance of W/O emulsion explosive compositions is greatly influenced by selection of the sensitizer to be added to W/O emulsion explosive compositions. The sensitizers to be used in W/O emulsion explosive compositions described in the above described United States Patent specifications are shown in the following Table 1.

TABLE 1

| U.S. Pat. No. | Used sensitizers |
|---|---|
| 3,212,945 | nitroglycerine, nitroglycol |
| 3,442,727 | glass hollow microsphere |
| 3,447,978 | glass hollow microsphere, aluminum |
| 3,765,964 | strontium salt, glass hollow microsphere |
| 3,356,547 | nitroglycerine, nitroglycol |
| 3,770,522 | glass hollow microscope, aluminum, chemical foaming agent |
| 3,674,578 | amine nitrate |

Although these various sensitizers have been used, these substances are highly dangerous or are low in initiation sensitivity or sympathetic detonation sensitivity. In the explosives using nitroglycerine and nitroglycol as the sensitizer, the same problem of headache as in dynamite occurs in view of production, and the sensitivity is very high in view of use, so that there is fear that an accidental explosion occurs when the cartridge is hit by a bit of a drilling machine and it can not be said that said explosive is safe. In the explosives using a strontium salt or an amine nitrate as the sensitizer, the former is very low in the sensitivity and acts as a catalyst in the detonation reaction, so that it is supposed that the sensitivity is low and particularly the sympathetic detonation sensitivity is very poor. The latter is very high in the water solubility, so that it is necessary in order to increase the sensitivity to allow to contain a larger amount and if the large amount is contained, an amount of an emulsifier and oils must be small in view of an oxygen balance. In this case, the ratio of oil volume/aqueous solution volume becomes very small and the formation of W/O emulsion becomes difficult and even if the emulsion can be formed, since the amount of oils is very small, the stability of W/O emulsion becomes low and the sensitivity becomes very poor. The inventors have take the above described problems into account and deligently studied for long period of time and found to obtain W/O emulsion explosive compositions having excellent stability in storage, explosion reactivity, detonability at low temperature, sympathetic detonation and safety, which have never been found in prior W/O emulsion explosive compositions by containing nitromethane which is far lower in the sensitivity than nitroglycerine, nitroglycol and the like and belongs to water insoluble substance together with bubbles in W/O emulsion composition, to make in contact with each other, and the present invention has been accomplished.

Namely, the present invention consists in W/O emulsion explosive compositions obtained by adding to an emulsion composition consisting of (a) ammonium nitrate or a mixture of ammonium nitrate and the other inorganic oxidizer salts (referred to as "inorganic oxidizer salts, such as ammonium nitrate" hereinafter), (b) water, (c) oils and/or waxes and (d) a sorbitan fatty acid ester surfactant, a mixture of (e) nitromethane gelatinized product obtained by gelatinizing nitromethane with a gelatinizer therefor and (f) hollow microspheres. In place of hollow microspheres (f), bubbles formed by using a chemical foaming agent or the thus formed bubbles together with hollow microspheres may be used. In these explosive compositions, the density is adjusted by means of the above described component (f).

W/O emulsion explosive composition according to the present invention can be prepared by the following process. The inorganic oxidizer salts, such as ammonium nitrate are totally or partially dissolved in water at a temperature of 55°-75° C. to obtain an aqueous solution of the oxidizer salts. A sorbitan fatty acid ester surfactant (emulsifier) and an oil and/or wax are mixed at a temperature of 55°-75° C. to obtain a homogeneous liquid mixture of an oil and/or wax and an emulsifier. Then, said aqeous solution and said homogeneous liquid mixture are mixed and agitated at a temperature of 55°-75° C. to obtain an emulsion composition, after which in the course where this emulsion composition having a temperature of 55°-75° C. is cooled while agitating, when the emulsion composition is converted into a completely opaque state from a transparent state, the agitation is stopped and if there are remaining inorganic oxidizer salts, such as ammonium nitrate, which has not been added to the above described aqueous solution of the oxidizer salts, said oxidizer salts are added to the emulsion composition and then a mixture of the nitromethane galatinized product obtained by mixing nitromethane and a gelatinizer therefor, with hollow microspheres is added thereto to obtain W/O emulsion explosive. When a chemical foaming agent is mixed without using hollow microspheres, the chemical foaming agent is added before or after adding the nitromethane gelatinized product to form bubbles. When hollow microspheres are used together with the chemical foaming agent, the chemical foaming agent is added before or after adding the nitromethane gelatinized product in the first preparation process to produce W/O emulsion explosive composition.

Components to be used in the present invention are as follows. Namely, as the other inorganic oxidizer salts used together with ammonium nitrate, mention may be made of nitrates, such as sodium nitrate, calcium nitrate and the like; chlorates, such as sodium chlorate and the like; perchlorates, such as sodium perchlorate and the like.

As oils and/or waxes, use may be made of oils, such as light oil, heavy oil and the like; waxes, such as paraffin wax, petrolatum wax, microcystalline wax and the like and these oils and/or waxes are used in various mixing ratios depending upon the desired consistency of the explosive composition.

As sorbitan fatty acid ester surfactants, which act as an emulsifier, mention may be made of sorbitan fatty acid esters, such as sorbitan monooleate, sorbitan sesquioleate, sorbitan monopalmitate, sorbitan monostearate and the like and the sorbitan surfactants are not particularly limited but sorbitan monooleate and sorbitan sesquioleate are preferable.

As nitromethane, use may be made of industrial nitromethane and a mixture of nitromethane, nitroethane and nitropropane. As gelatinizer for nitromethane, nitrocellulose is generally effective and acrylic acid ester polymers may be used.

As the hollow microsphere and/or chemical foaming agent (hereinafter referred to as density controlling agent), the following hollow microspheres and chemical foaming agents can be used. The hollow microspheres include glass hollow microsphere, synthetic resin hollow microsphere, silica hollow microsphere, shirasu hollow microsphere (shirasu is a kind of silica) and the like. It is not necessary that these hollow microspheres are fine and expensive hollow microspheres, but coarse hollow microspheres having an average particle size of about 500 μm can be used. The chemical foaming agents include inorganic foaming agents, for example, a mixture of alkali metal borohydride or sodium nitrite with urea, and organic foaming agents, such as N,N'-dinitrosopentamethylenetetramine, azodicarbonamide, azobisisobutyronitrile and the like.

The compounding recipe of these components for the W/O emulsion explosive compositions of the present invention should be determined by taking oxygen balance, detonability, strength, consistency and productivity into consideration. In general, 50-90% (% means by weight) of the inorganic oxidizer salts, such as ammonium nitrate, 5-20% of water, 1-7% of an oil and/or wax, 1-5% of an emulsifier, 3-20% of nitromethane, 0.1-3% of a gelatinizer for nitromethane, 1-10% of hollow microspheres and 0.1-2% of a chemical foaming agent are compounded.

Coal mine explosive having a high safety which does not ignite methane gas and coal dust in coal mine, can be obtained by adding a flame coolant, such as sodium chloride, potassium chloride to W/O emulsion explosive of the present invention.

The present invention will be explained in more detail referring to examples and comparative examples. In the examples, "parts" and "%" mean by weight.

In evaluation of W/O emulsion explosive compositions prepared in the Comparative examples and Examples, the emulsion stability in storage was determined by the temperature cycle test, the detonability and the explosion reactivity were determined by the initiation test at low temperature and the explosion velocity at that time, and the air gap test was carried out on sand at 5° C.

The temperature cycle test was carried out as follows. A sample was kept for 14 hours in a thermostat at 0° C. and then transferred to a thermostat at 40° C. and kept for 7 hours, which was referred to as one cycle. This was repeated and the cycle number when the W/O emulsion was broken, was determined. It was judged that the emulsion breakage occurs when the precipitation of ammonium nitrate crystal and the separation of water are observed on the explosive surface and this phenomenon suddenly appears.

The initiation test at low temperature (detonability), the measurement of explosion velocity (explosion reactivity) and the air gap test were carried out after a W/O emulsion explosive composition was charged in a polyethylene tube having a diameter of 25 mm and a length of 200 mm and then the end was sealed to obtain a cartridge and the cartridge was subjected to the temperature cycle test. Namely, the initiation test at low temperature was carried by putting the sample in a low temperature thermostat to adjusting the sample to a test temperature and then inserting a probe for measuring the explosion velocity into the sample and initiating the sample on sand and in an unconfined state by No. 6 electric blasting cap and measuring the explosion velocity by a digital counter.

The air gap test was expressed by a value of air gap test, which was determined as follows. The temperature of the sample was adjusted at +5° C. and then an initiator cartridge and a receptor cartridge into each of which No. 6 electric blasting cap was inserted, were put on sand at interval of various times as large as the cartridge diameter and the initiator cartridge was initiated to detonate the receptor cartridge. The distance between the initiator cartridge and the receptor cartridge was shown by the time number of the diameter of the sample cartridge as the value of air gas test.

The following examples are given for the purpose if illustration of this invention and are not intended as limitations thereof.

COMPARATIVE EXAMPLE 1

A W/O emulsion explosive composition having a compounding recipe shown in the following Table 2 was produced in the following manner. To 36 parts of water were added 160 parts of ammonium nitrate, 40 parts of sodium nitrate and 40 parts of calcium nitrate, and the resulting mixture was heated at about 65° C. to dissolve the nitrates in water and to obtain an aqueous solution of the oxidizer salts. While, 8 parts of butyl stearate as an emulsifier was added to 14 parts of No. 2 light oil, and the resulting mixture was heated at about 65° C. to obtain a homogeneous liquid mixture of the emulsifier and the oil. The aqueous solution of the oxidizer salts was gradually added to the homogeneous liquid mixture of the emulsifier and the oil while agitating at a rate of about 300 rpm by means of a commonly used propeller blade-type agitator. After completion of the addition, the resulting mixture was further agitated at a rate of 1,500 rpm to prepare an emulsion composition at about 65° C. The emulsion composition at about 65° C. was left to stand and when the temperature became about 60° C., the emulsion was again agitated at a rate of about 500 rpm and when the emulsion was converted into an opaque state from a transparent state, the agitation was stopped and the emulsion was left to stand. When the temperature became about 40° C., 24 parts of glass hollow microspheres was added thereto as a density controlling agent to produce a W/O emulsion explosive composition.

The thus obtained W/O emulsion explosive composition was subjected to the temperature cycle test and the initiation test at low temperature and the obtained results are shown in Table 2.

COMPARATIVE EXAMPLES 2-6

W/O emulsion explosive compositions having the compounding recipe showin in Table 2 were prepared in the same manner as described in Comparative example 1 and subjected to the temperature cycle test and the air gap test (only in Comparative examples 5 and 6).

EXAMPLE 1

A W/O emulsion explosive composition having a compounding recipe shown in Table 2 was produced in the following manner. To 48 parts of water were added 210 parts of ammonium nitrate, 55 parts of sodium nitrate and 55 parts of calcium nitrate, and the resulting mixture was heated to about 65° C. to dissolve the nitrates in water and to obtain an aqueous solution of the oxidizer salts. While, 6 parts of sorbitan sesquioleate was added to 12 parts of No. 2 light oil and the resulting mixture was heated to about 65° C. to prepare a homogeneous liquid mixture of the emulsifier and the oil. The aqueous solution of the oxidizer salts was gradually added to the homogenous liquid mixture of the emulsifier and the oil.

This emulsion composition having a temperature about 65° C. was left to stand for sometime and when the temperature became about 60° C., the emulsion was again agitated at a rate of about 500 rpm and when the emulsion was converted into an opaque state from a transparent state, the agitation was stopped and the emulsion was left to stand until the temperature of the emulsion became about 40° C. When the temperature became about 40° C., nitromethane gelatinized product consisting of 72 parts of nitromethane and 4 parts of nitrocellulose and 21 parts of glass hollow microspheres were added thereto to obtain a W/O emulsion explosive composition. This emulsion explosive composition was subjected to the temperature cycle test, the initiation test at low temperature and the air gap test and the obtained results are shown in Table 2.

EXAMPLES 2-11

W/O emulsion explosive compositions as shown in Table 2 were prepared in the same manner as described in Example 1 and subjected to the temperature cycle test, the initiation test at low temperature and the air gap test. The obtained results are shown in Table 2. However, in Examples 4 and 10, after preparing the samples, the samples were heated in a thermostat at about 50° C. for 2 hours to decompose and foam N,N'-dinitrosopentamethylenetetramine, whereby the density was lowered.

TABLE 2(a)

| | | | Comparative example | | | | | | Example | | | | | | | | | | |
|---|---|---|---|---|---|---|---|---|---|---|---|---|---|---|---|---|---|---|---|
| | | | 1 | 2 | 3 | 4 | 5 | 6 | 1 | 2 | 3 | 4 | 5 | 6 | 7 | 8 | 9 | 10 | 11 |
| Compounding recipe (%) | Aqueous solution of oxidizer | ammonium nitrate | 49.7 | 49.7 | 49.7 | 49.7 | 49.7 | 49.7 | 43.5 | 43.5 | 43.5 | 77.3 | 55.5 | 55.5 | 55.5 | 58.4 | 60.3 | 55.5 | 60.3 |
| | | sodium nitrate | 12.4 | 12.4 | 12.4 | 12.4 | 12.4 | 12.4 | 11.4 | 11.4 | 11.4 | — | 14.0 | 14.0 | 14.0 | 14.7 | 15.2 | 14.0 | 15.2 |
| | | calcium nitrate | 12.4 | 12.4 | 12.4 | 12.4 | 12.4 | 12.4 | 11.4 | 11.4 | 11.4 | — | — | — | — | — | — | — | — |
| | | water | 11.2 | 11.2 | 11.2 | 11.2 | 11.2 | 11.2 | 9.9 | 9.9 | 9.9 | 7.5 | 9.0 | 9.0 | 10.9 | 9.5 | 9.8 | 9.0 | 9.8 |
| | Emulsifier[1] | (1) | 2.5 | — | — | — | — | — | — | — | — | — | — | — | — | — | — | — | — |
| | | (2) | — | 2.5 | — | — | — | — | — | — | — | — | — | — | — | — | — | — | — |
| | | (3) | — | — | 2.5 | — | — | — | — | — | — | — | — | — | — | — | — | — | — |
| | | (4) | — | — | — | 2.5 | — | — | — | — | — | — | — | — | — | — | — | — | — |
| | | (5) | — | — | — | — | 2.5 | — | 1.2 | 1.2 | 1.2 | 0.9 | — | — | 1.1 | 1.5 | 1.2 | 1.1 | 1.2 |
| | | (6) | — | — | — | — | — | 2.5 | — | — | — | — | 1.1 | — | — | — | — | — | — |
| | | (7) | — | — | — | — | — | — | — | — | — | — | — | 1.1 | — | — | — | — | — |
| | Oils or waxes | No. 2 light oil | 4.3 | 4.3 | 4.3 | 4.3 | 4.3 | 4.3 | 2.5 | 2.5 | 2.5 | 1.9 | — | — | — | — | — | — | .8 |
| | | unpurified microcrystalline wax | — | — | — | — | — | — | — | — | — | — | 2.3 | 2.3 | 2.3 | 2.9 | 3.6 | 2.3 | 1.8 |

Note [1]: Name of emulsifiers
(1) butyl stearate
(2) polyoxyethyleneoctadecylamine
(3) alkyl (coconut oil) phosphate
(4) alkyl (coconut oil) alkylolamide
(5) sorbitan sesquioleate
(6) sorbitan monopalmitate
(7) sorbitan monooleate

TABLE 2 (b)

| | | Comparative example | | | | | | Example | | | | | | | | | | |
|---|---|---|---|---|---|---|---|---|---|---|---|---|---|---|---|---|---|---|
| | | 1 | 2 | 3 | 4 | 5 | 6 | 1 | 2 | 3 | 4 | 5 | 6 | 7 | 8 | 9 | 10 | 11 |
| Compounding recipe (%) | N M[8] | — | — | — | — | — | — | 14.9 | 14.9 | 14.9 | 11.3 | 13.5 | 13.5 | 13.5 | 8.4 | 5.4 | 15.2 | 5.4 |
| | N C[8] | — | — | — | — | — | — | 0.8 | 0.8 | 0.8 | 0.6 | 0.7 | 0.7 | 0.7 | 0.4 | 0.2 | 0.7 | 0.2 |
| | Density control-ling agent: hollow glass resin[2] | 7.5 | 7.5 | 7.5 | 7.5 | 7.5 | 7.5 | 4.4 | — | — | — | 3.9 | 3.9 | 2.0 | 4.2 | 4.3 | 2.0 | 4.3 |
| | Density control-ling agent: hollow micro-sphere shirasu | — | — | — | — | — | — | — | 4.4 | — | — | — | — | — | — | — | — | — |
| | Density control-ling agent: Chemical[3] foaming agent | — | — | — | — | — | — | — | — | 4.4 | — | — | — | — | — | — | — | — |
| | | — | — | — | — | — | — | — | — | — | 0.5 | — | — | — | — | — | 0.2 | — |

TABLE 2 (c)

| | | | | | | | | | | | | | | | | | | | |
|---|---|---|---|---|---|---|---|---|---|---|---|---|---|---|---|---|---|---|---|
| Evaluation Stability after temperature cycle[4] | | break 3 20° C. | break 4 20° C. | break 4 20° C. | break 3 20° C. | good 10 −5° C. | good 10 −5° C. | good 10 −20° C. | good 10 −20° C. | good 10 −20° C. | good 10 −20° C. | good 10 −20° C. | good 10 −20° C. | good 10 −10° C. | good 10 −10° C. | good 10 −10° C. | good 10 −20° C. | good 10 −10° C. |
| Performance after temperature cycle | Detonability: Initiation at low temperature[5] | not | not | not | not | do | do | do | do | do | do | do | do | do | do | do | do | do |
| | Explosion reactivity: Explosion velocity[6] m/s | — | — | — | — | 3,620 | 3,730 | 4,320 | 4,230 | 3,860 | 4,010 | 4,390 | 4,360 | 4,530 | 4,150 | 4,010 | 4,290 | 4,180 |
| | Value of air gap test[7] | — | — | — | — | 1 | 1 | 4 | 4 | 4 | 4 | 4 | 4 | 4 | 3 | 2 | 4 | 3 |
| Density (g/cc) | | — | — | — | — | 1.05 | 1.07 | 1.13 | 1.14 | 1.14 | 1.10 | 1.16 | 1.16 | 1.22 | 1.14 | 1.16 | 1.12 | 1.16 |

Note [2]: Phenol resin hollow microspheres
Note [3]: N,N'-dinitrosopentamethylenetetramine
Note [4]: "break: and "good" show the state of the emulsion after the temperature cycle was effected in the shown times, that is "break" shows that the emulsion is broken and "good" shows that the emulsion state is maintained. The figures shows the time of the temperature cycle.
Note [5]: The figure shows the sample temperature when the initiation test at low temperature is carried out. "not" shows that the detonation does not occur and "do" shows that the detonation occurs.
Note [6]: The figures show the value when the detonation occurs at the initiation test at low temperature.
Note [7]: The figures show the value when the test is carried out three times and the receptor cartridges detonate in all three times.
Note [8]: NM nitromethane NC nitrocellulose Then, the results in Comparative examples and Examples will be explained in more detail. In comparative examples 1, 2, 3 and 4, butyl stearate, polyoxyethyleneoctadecylamine, alkyl (coconut oil) phosphate and alkyl (coconut oil) alkylolamide were used as the emulsifier respectively and the emulsions were prepared following to the production process as described above. However, when the temperature cycle test was carried out, the emulsions were broken after three times, four times, four times and three times respectively. In Comparative examples 5 and 6, by using sorbitan surfactants W/O emulsion explosive compositions were prepared following to the above described production process. When these explosive compositions were subjected to the above described tests, the good results were obtained in the temperature cycle test but the detonability at low temperature, the explosion velocity and the value of air gap test were poor and among them, the value of air gap test was very poor.

Example 1 was an explosive composition using sorbitan sesquioleate as the emulsifier and containing about 15% of nitromethane and showed the equal result in the temperature cycle test to Comparative examples 5 and 6 but the detonation occurred at −20° C., the explosion velocity was 4,320 m/s and the value of air gap test was 4 times and this explosion composition had very excellent performance.

Examples 2, 3 and 4 were the W/O emulsion explosive compositions prepared by using the same emulsifier as in Example 1 and synthetic resin hollow microspheres, shirasu hollow microspheres and N,N'-dinitrosopentamethylenetetramine as the density controlling agent in the above described production process and when the obtained W/O emulsion explosive compositions were subjected to the temperature cycle test, even if ten times cycles were effected, any properties were not varied and when the initiation was effected by using No. 6 electric blasting cap, the explosion velocity was 4,230 m/s, 3,860 m/s and 4,010 m/s respectively. The reason why the explosion velocity in the explosive composition using shirasu hollow microspheres is low, was based on the fact that the particle size of shirasu hollow microspheres was larger than that of glass hollow microspheres.

Examples 5 and 6 were the explosive compositions prepared by using sorbitan monopalnitate and sorbitan monooleate as the emulsifier and obtained the same results as in Examples 1–4. In Example 7, an amount of the density controlling agent used was smaller than that of the other examples, so that the density of the emulsion explosive composition was naturally higher but the performance of this explosive composition was substantially same as in the other examples.

In Examples 8 and 9, the content of nitromethane was 8.4% and 5.4% respectively and the amount of the sensitizer was reduced but the results in these examples were more excellent then those of Comparative examples.

Example 10 used glass hollow microspheres together with a chemical foaming agent and the same excellent results as in the other examples were obtained.

The above described Comparative examples and Examples have proved that the present invention can provide excellent stability in storage, detonability at low temperature, explosion velocity and sympathetic detonation which have ner been obtained in prior W/O emulsion explosive compositions.

We claim:

1. Water-in-oil emulsion explosive compositions obtained by dispersing a mixture of (a) a gelatinized nitromethane product obtained by mixing nitromethane with a gelatinizer for nitromethane and (b) hollow microspheres in a water-in-oil emulsion composition comprising (i) ammonium nitrate or a mixture of ammonium nitrate and at least one other inorganic oxidizer salt, (ii) water, (iii) at least one of an oil and wax, and (iv) a sorbitan fatty acid ester surfactant.

2. Water-in-oil emulsion explosive compositions obtained by dispersing (a) a gelatinized nitromethane product obtained by mixing nitromethane with a gelatinizer for nitromethane and (b) bubbles in a water-in-oil emulsion composition comprising (i) ammonium nitrate or a mixture of ammonium nitrate and at least one other inorganic oxidizer salt (ii) water, (iii) at least one of an oil and wax and (iv) a sorbitan fatty acid ester surfactant, said bubbles having been formed by adding a chemical foaming agent to the water-in-oil emulsion composition before or after the gelatinized nitromethane product is added to the water-in-oil emulsion composition.

3. Water-in-oil emulsion explosive compositions obtained by dispersing a mixture of (a) a gelatinized nitromethane product obtained by mixing nitromethane with a gelatinizer for nitromethane, (b) hollow microspheres in a water-in-oil emulsion composition comprising (i) ammonium nitrate or a mixture of ammonium nitrate and at least one other inorganic oxidizer salt (ii) water, (iii) at least one of an oil and wax and (iv) a sorbitan fatty acid ester surfactant, wherein said emulsion also contains bubbles, said bubbles having been formed by adding a chemical foaming agent to the water-in-oil emulsion composition before or after the gelatinized nitromethane product and microsphere mixture is added to the water-in-oil emulsion composition.

4. Water-in-oil emulsion explosive compositions as claimed in any of claims 1, 2 or 3, wherein the other inorganic oxidizer salts are selected from the group consisting of sodium nitrate, potassium nitrate, sodium chlorate, and sodium perchlorate.

5. Water-in-oil emulsion explosive compositions as claimed in any of claims 1, 2 or 3, wherein the oil or wax is selected from the group consisting of a light oil, a heavy oil, a paraffin wax, petrolatum wax and microcrystalline wax.

6. Water-in-oil emulsion explosive compositions as claimed in any of claims 1, 2 or 3, wherein the sorbitan fatty acid ester surfactant is selected from the group consisting of sorbitan monooleate, sorbitan sesquioleate, sorbitan monopalmitate and sorbitan monostearate.

7. Water-in-oil emulsion explosive compositions as claimed in any of claims 1, 2 or 3, wherein the gelatinizer for nitromethane is nitrocellulose.

8. Water-in-oil emulsion explosive compositions as claimed in any of claims 1, 2 or 3, wherein the hollow microsphere is glass hollow microsphere, synthetic resin hollow microsphere, silica hollow microsphere or shirasu hollow microsphere.

9. Water-in-oil emulsion explosive compsotions as claimed in any of claims 2, or 3, wherein the chemical foaming agent is a mixture of alkali metal borohydride or sodium nitrite with urea, N,N'-dinitrosopentamethylenetetramine, azodicarbonamide or azobisisobutyronitril.

10. Water-in-oil emulsion explosive compositions as claimed in any of claims 1, 2 or 3, wherein ammonium nitrate and the other inorganic oxidizer salts are 50–90% by weight, water is 5–20% by weight, at least one of an oil and wax is 1–7% by weight, a sorbitan fatty acid ester surfactant is 1–5% by weight, nitromethane is 3–20% by weight and the gelatinizer for nitromethane is 0.1–3% by weight.

11. Water-in-oil emulsion compositions as claimed in any of claims 1 or 3, wherein the hollow microsphere comprises 1–10% by weight, based on the weight of the emulsion.

12. Water-in-oil emulsion explosive compositions as claimed in any of claims 2 or 3, wherein the chemical foaming agent is 0.1–2% by weight, based on the weight of the emulsion.

* * * * *